US007794191B2

(12) United States Patent
Hawley et al.

(10) Patent No.: US 7,794,191 B2
(45) Date of Patent: Sep. 14, 2010

(54) METHODS AND SYSTEMS FOR PROVIDING LARGE-SCALE BOOKS

(76) Inventors: Michael Hawley, 101 Third St., Cambridge, MA (US) 02141; Paul A. Parisi, Acme Bookbinding, 100 Cambridge St., P.O. Box 290699, Charlestown, MA (US) 02129-0212; Wladyslaw Hanower, Melrose, MA (US); Pam Hanower, legal representative, 2 Sylvan St., Melrose, MA (US) 02176; Pete Merrill-Oldham, 5 Appleton Rd., Cambridge, MA (US) 02138

( * ) Notice: Subject to any disclaimer, the term of this patent is extended or adjusted under 35 U.S.C. 154(b) by 102 days.

(21) Appl. No.: 11/014,219

(22) Filed: Dec. 15, 2004

(65) Prior Publication Data

US 2005/0276678 A1 Dec. 15, 2005

Related U.S. Application Data

(60) Provisional application No. 60/529,792, filed on Dec. 15, 2003.

(51) Int. Cl.
*B42C 1/00* (2006.01)
*B42D 1/00* (2006.01)

(52) U.S. Cl. ..... 412/6; 281/21.1; 402/500

(58) Field of Classification Search ..... 281/2, 281/3.1, 15.1, 38, 45–47, 51, 21.1, 10, 12, 281/14, 23, 27.1–27.3, 28, 9; 283/3, 4; 412/1, 412/3, 4, 6; 402/500
See application file for complete search history.

(56) References Cited

U.S. PATENT DOCUMENTS

| | | | | | |
|---|---|---|---|---|---|
| 736,339 | A | * | 8/1903 | Akass | 281/50 |
| 981,554 | A | * | 1/1911 | Hager et al. | 281/23 |
| 1,557,170 | A | * | 10/1925 | Kaufmann | 281/15.1 |
| 1,861,459 | A | * | 6/1932 | Smith | 281/15.1 |
| 3,315,683 | A | * | 4/1967 | Rodriguez et al. | 402/79 |
| 3,560,290 | A | * | 2/1971 | Sendor et al. | 156/227 |
| 3,907,271 | A | * | 9/1975 | Lyon, Jr. | 270/37 |
| 4,360,183 | A | * | 11/1982 | Biasini | 248/451 |
| 4,878,776 | A | * | 11/1989 | Orlandini | 402/4 |
| 4,961,666 | A | * | 10/1990 | Pitts et al. | 402/79 |
| 5,192,093 | A | * | 3/1993 | Zeisky et al. | 281/5 |
| 5,725,196 | A | * | 3/1998 | Scheel | 281/21.1 |

FOREIGN PATENT DOCUMENTS

JP 10315655 A * 12/1998

* cited by examiner

*Primary Examiner*—Dana Ross
*Assistant Examiner*—Pradeep C Battula
(74) *Attorney, Agent, or Firm*—GTC Law Group LLP & Affiliates

(57) ABSTRACT

In a method for producing large-scale pages of a book, one or a plurality of long sheets of paper or other flexible material is folded in an alternative forward and reverse direction along a single axis, yielding an accordion fold structure. Such pages are bound along a single edge to yield a book of enormous proportion. According to one exemplary embodiment, each page of the book is of approximately five feet by seven feet in dimension, yielding a compelling visual display that may contain life-sized portraits, brilliant landscapes, detailed maps, a panoply of disparate visual images, text, diagrams, or blank pages for creative uses. Methods of binding may include tabbing folds of the pages and then stitching through the tabs.

6 Claims, 19 Drawing Sheets

METHODS AND SYSTEMS FOR PROVIDING LARGE-SCALE BOOKS

CROSS-REFERENCE TO RELATED APPLICATION

The present application claims the benefit, under 35 U.S.C. §119(e), of U.S. Provisional Application Ser. No. 60/529,792, filed Dec. 15, 2003, entitled "Methods and Systems for Providing Large-Scale Books," which is hereby incorporated by reference herein.

BACKGROUND

1. Field of the Invention

This invention relates to the field of books, and more particularly to the field of large-scale books.

2. Description of the Related Art

The invention relates to books and to methods and systems for binding books. In embodiments, the books may be large-scale books. Traditionally, books are designed to be portable, easily shared and conveniently accumulated on conventional bookshelves. As such, the dimensions of books have been relatively small, conventionally being less than twenty inches in height and less than one foot in width. The dimensions of the book in turn limit the amount of information contained in a book, whether visual or textual. In particular the amount of detail that can be provided in graphical depictions, such as photographs, diagrams, charts, maps and the like, is limited by the size of images that can be displayed on a page. Various techniques, such as fold-out pages, centerfold pages, and multi-page graphical depictions have been developed to allow larger graphical formats in small-scale books; however, even those techniques are inherently limited by the size of the book and may present complexities or incremental costs in constructing the book.

While bookbinding methods and systems have remained relatively stable over the past half-century, other related publishing fields have undergone dramatic changes. For example, the development of large-format computer printers, such as inkjet and laser jet printers, as well as the development of large-format printer papers, have enabled the rapid, inexpensive production of very-large, high-quality printed photographs and other graphics.

Accordingly, a need exists for techniques for developing large-scale books that can accommodate large-format graphical depictions such as those produced by large-format printers.

SUMMARY

In embodiments, the present invention entails production of a very large book that may be used to display vast amounts of information in a striking and highly-detailed format. Rather than compromising content and imagery for convenient handling, the book is designed to accommodate the output from modern large-format printers. In embodiments the book may rest in a fixed position for display or may be designed for convenient transport. Because conventional book-binding methods are optimized for articles with traditional book dimension, new methods and systems of manufacture are provided herein.

Methods and systems are provided herein for manufacturing books with large-scale pages. The methods and systems include folding one or more elongated sheets of a material, such as paper, in an alternative forward and reverse direction along a single axis, yielding an accordion fold structure. The pages of the book are bound along one edge to yield a book of enormous proportion.

According to one exemplary embodiment disclosed herein, the methods and systems for producing the book include folding a sheet of pliable material in an alternating forward and reverse direction along a longitudinal axis of the sheet to create a plurality of folded pages, positioning the folded pages into a stack, and binding the folded pages to form the book.

In one aspect, folding the pliable material may be facilitated by scoring or perforating the sheet along the length of each page prior to folding. The sheet may then be folded through use of a bending facility or apparatus, which may entail use of a mechanical folding device or hand folding.

In another aspect, binding may be accomplished by tabbing the folded pages along the binding side of the pages, and then stitching through the tabs to create a spine. The tabs may be spaced at a distance to provide adequate stability for the spine and, advantageously may be uniformly distributed along the length of the spine. The tabs may be formed from cloth, cardboard, plastic, or from another material offering adequate durability and pliability.

In another aspect, the tabs may be affixed to every fold of the binding side of the folded pages. Alternatively, the tabs may be interleaved among every second, third, fourth, or nth fold of the binding side of the folded pages.

In another aspect, the tabs may be stitched together using a fastener facility. String, screws, bolts, posts, or any other means of attachment may be used to stitch the tabs together. The stitching may also include a reinforcement facility, such as a cardboard strip along the binding side of the folded pages, or cardboard elements situated between the tabs and the pages. The fastener facility would then fasten through the cardboard binding or bindings at the tabs.

In another aspect, the book may be bound through stapling, clipping, comb binding, clamping, tabbed binding, stitched binding, perfect-binding, cloth binding, spiral binding, tape-binding, hinge-binding, post-binding or a combination of the foregoing. In another aspect, the sheet or sheets used to create pages may be made of paper, parchment, cloth, foam, plastic, or any material susceptible to printing that is suitably rigid. The sheet material may be of a variety that resists sagging. The sheet material may also be optimized to fold easily along the vertical axis to create pages but resist bending along the horizontal, to promote stability.

In one exemplary embodiment, the sheet is made of archival quality printer paper. Alternatively, other grades of paper, or parchment, cloth, foam or other materials may be used to construct the sheet. The sheet may be coated or laminated with a protective film.

In another aspect, the sheet may have dimensions, prior to folding, of at least four feet in width by at least fifty feet in length. In such case, the folded pages may have dimensions of at least two feet by four feet. Prior to folding, the sheet may be a single, continuous sheet or, alternatively, may consist of multiple linked sheets of shorter length.

In another aspect, a cover may be physically associated with one or both ends of the book prior to binding. It is also possible to affix one or both covers after original binding. The cover may be attached to at least one end page of the book, such as through use of an adhesive, or it may be attached to the pages solely through binding. One or both covers may also be removable, if releasably fastened to an end of the book. The cover may also contain a pocket, slot, or other mechanism for inserting additional material. In addition, pages of the book may include a pocket, slot, or other mechanism for inserting additional material.

In another aspect, covers of the book may be comprised of corrugated cardboard. The corners of one or both book covers may be reinforced to withstand forces. This may be accomplished by applying a warm or hot adhesive, which is solid at ambient temperature, into the corners of the corrugated cardboard and then allowing or causing the adhesive to dry and harden. Other reinforcements may be used as well, such as plating with a rigid material like metal.

In a preferred embodiment, the sheet may be pre-printed with images, diagrams, text, lists, instructions, photographs, maps, musical compositions, or anatomical information. In one aspect, images, such as pictures of people, animals or plants, may be replicated at approximately actual size. The pages may also be pre-printed with religious text, a catalog of available store items, poetry, children's stories, or educational text.

In one aspect, each page or set of contiguous pages of the book may present substantially the same material translated into different languages. Alternatively, the content of one or more pages of the book may include enlarged versions of corresponding pages of an existing book, pamphlet, periodical or other publication. One or more of the pages may also be blank and suitable for insertion of material after binding. For example, a book may offer blank pages that may be submitted for artwork by students in a classroom setting.

In another aspect, the book may include a hanging ribbon affixed to the spine of the book, in order to serve as a placeholder or as a decorative element. If the book has a cover, a protective or decorative jacket may be placed over the cover.

In another embodiment, a stand designed to support the book may be included with the book. In another aspect, a means to transport the book may be included. The stand itself may have wheels or other means of locomotion, and serve the dual purpose of facilitating transport of the book. Alternatively, the stand may reside on a movable platform for transporting the book. The stand may be made of wood, or of another structural material.

In another aspect, the rear cover of the book may be rotatably mounted to the top of the book. This may be accomplished through use of a hinged element. The rear cover may either be adjacent the final page of the book, or may be adjacent an internal cover operating as a support structure.

In another aspect, the book may be maintained in a closed position through use of a releasable latch. The latch may include a locking mechanism, such as a key facility or combination lock facility.

In another aspect, a fastener may be secured to either the rear cover or the spine of the book. The fastener may attach the book to either a vertical platform, such as a stand, or to a wall.

In another aspect, a support structure capable of accommodating climbing access to various parts of the book may be included with the book.

In another aspect, articulated members of a structural material may be affixed to the spine or cover of the book in order to position and support the book.

In another embodiment, the book may contain a theme, such as commemoration of an event, such as a wedding, holiday, anniversary, birth, graduation, vacation, or historical event. The book may also have a theme referencing a geographic region, or a demographic or social group.

All patents, patent applications, specifications and other documents referenced herein are hereby incorporated by reference.

It should be appreciated that all combinations of the foregoing concepts and additional concepts discussed in greater detail below are contemplated as being part of the inventive subject matter disclosed herein. In particular, all combinations of claimed subject matter appearing at the end of this disclosure are contemplated as being part of the inventive subject matter disclosed herein.

DETAILED DESCRIPTION

Figure 1:
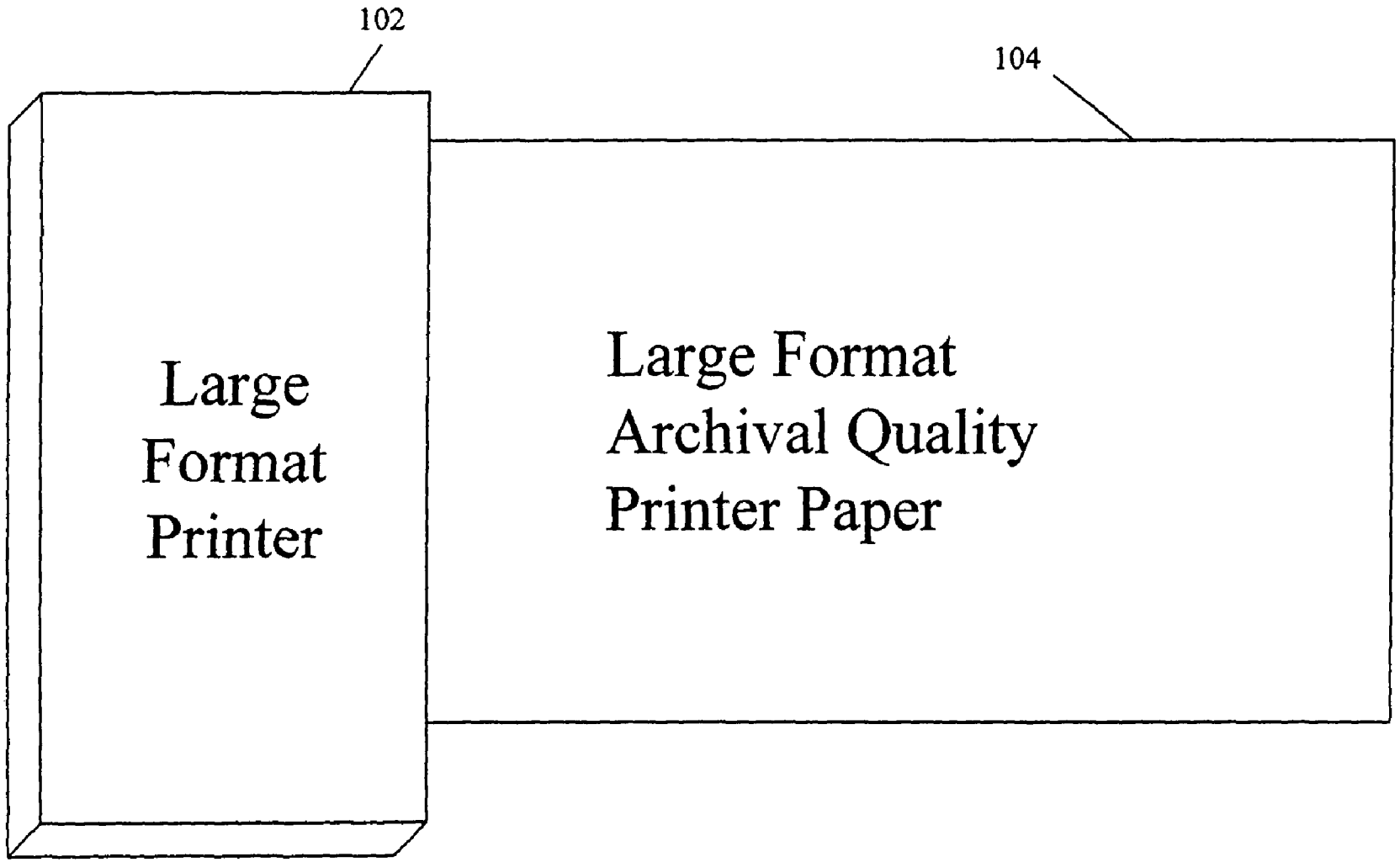
FIG. 1 is a perspective view of a large-format printer generating text or images on large-format archival quality print paper.

In accordance with one embodiment of the invention, FIG. 1 illustrates the use of a large-format or wide-format printer or plotter 102 (such as a Hewlett-Packard large-format DesignJet printer or plotter, ENCAD wide-format inkjet printer, or similar products offered by 3M, Accuplot, Agfa, Alpha Merics Corp., ANAgraph Inc., Fuji Hunt, Canon, ColorgrapfX, MacDermid Graphic Arts, Cymbolic Sciences, Epson, Gerber Scientific, Ilford, Kodak, Mile High, Mimaki/ICS, Mutoh, Oce, Olympus, Opaate, Phoenix Precision Graphics, Raster Graphics, Roland DGA Corp., CreoScitex, Seiko, Selex, SignWarehouse, Summa Digital Imaging Technology, Tektronix, Western Graphtec, Xerox) printing on large-format or wide-format paper, optionally archival quality printer paper 104 (such as paper offered by Hewlett-Packard or Epson, in matte, photographic, bond, basic coated, high gloss, photo-satin, ink jet, vellum, or other format). The sheet may optionally be coated or laminated with a protective film.

Figure 2:
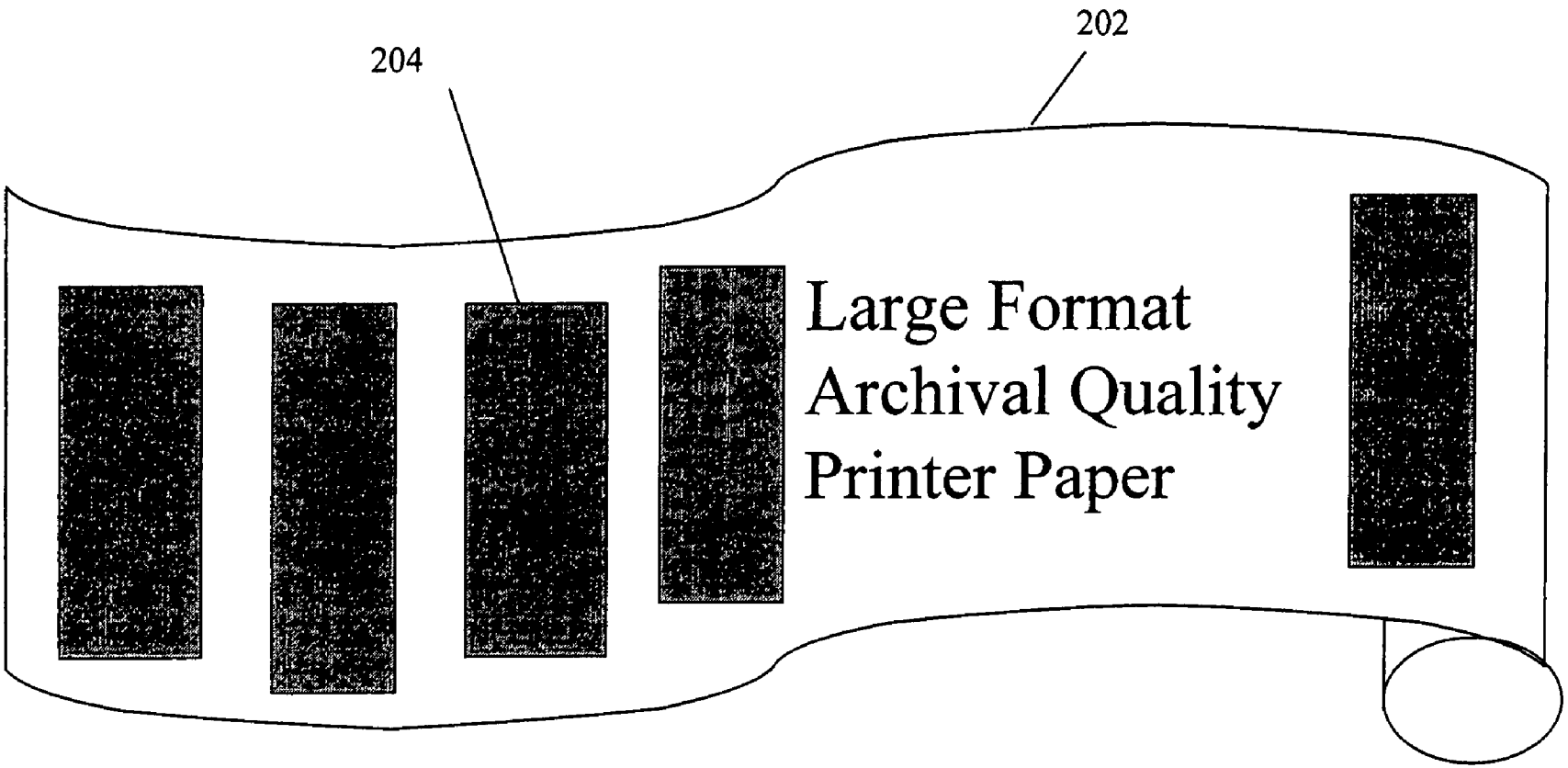
FIG. 2 is a long sheet of large-format archival quality print paper depicting text or images printed thereon.

FIG. 2 reveals the resultant strip of large-format or wide-format archival quality printer paper 202 with printed material 204, which printed material may be formed into pages of the book. The sheet in FIG. 2 may constitute a single continuous sheet, or it may consist of a plurality of linked sheets. In addition, the sheet in FIG. 2 may be composed of paper, parchment, cloth, foam, plastic or a material that resists sagging. The sheet in FIG. 2 may also be composed of a material that folds easily along the longitudinal axis, so as to permit the sheet to be bent into pages, but that may be less flexible in latitudinal axis, so as to resist drooping or sagging. In a preferred embodiment, the sheet will have dimensions of at least fifty feet in length and four feet in width. Other sheet configurations may be used as well, ranging from approximately one to twenty or more feet in width, and extending from a few feet up to several hundred feet in length. The length of the sheet allows folding into a desired number of pages of a desired width. For example, if the width of each page of the book is three and one-half feet, then a book of one hundred pages would require a three hundred fifty foot length of paper.

The sheet 202 in FIG. 2 may be preprinted with one or a plurality of graphics, images, diagrams, charts, graphs, animations, cartoons, pictures, text, lists, instructions, photographs, maps, musical compositions, anatomical information or other text or images. In embodiments, the images may be scaled or may be of approximately actual dimension. For example, the sheet 202 may be pre-printed with images of human beings, animals or plant species of approximately actual dimension, so that when viewed, the books gives the viewer a sense of immersion in the environment depicted by the book. The sheet 202 may also be pre-printed with religious text, a store catalogue, poetry, fairy tales, comic strips, fiction, non-fiction, educational material, medical material, economic analysis, historical information, genetic information, genealogical information, biographical information, autobiographical information, an enlarged reproduction of text contained in an existing publication or any of a wide variety of other types of information.

In embodiments, the sheet 202 may replicate substantially identical text translated into various languages. Whereas conventional translated materials cannot conveniently represent more than one language without severely limiting the content of material on a single page, a large format allows translation of text into various languages. Thus, for example, if text is used to describe a complicated figure, all of the text can be accommodated, in multiple languages, on the same page as the figure.

In embodiments the sheet 202 may also contain blank pages for subsequent application or attachment of images or text. The pages may be adapted to include pocket means or slots for insertion of additional material, such as additional sheets or three-dimensional articles.

Figure 3:
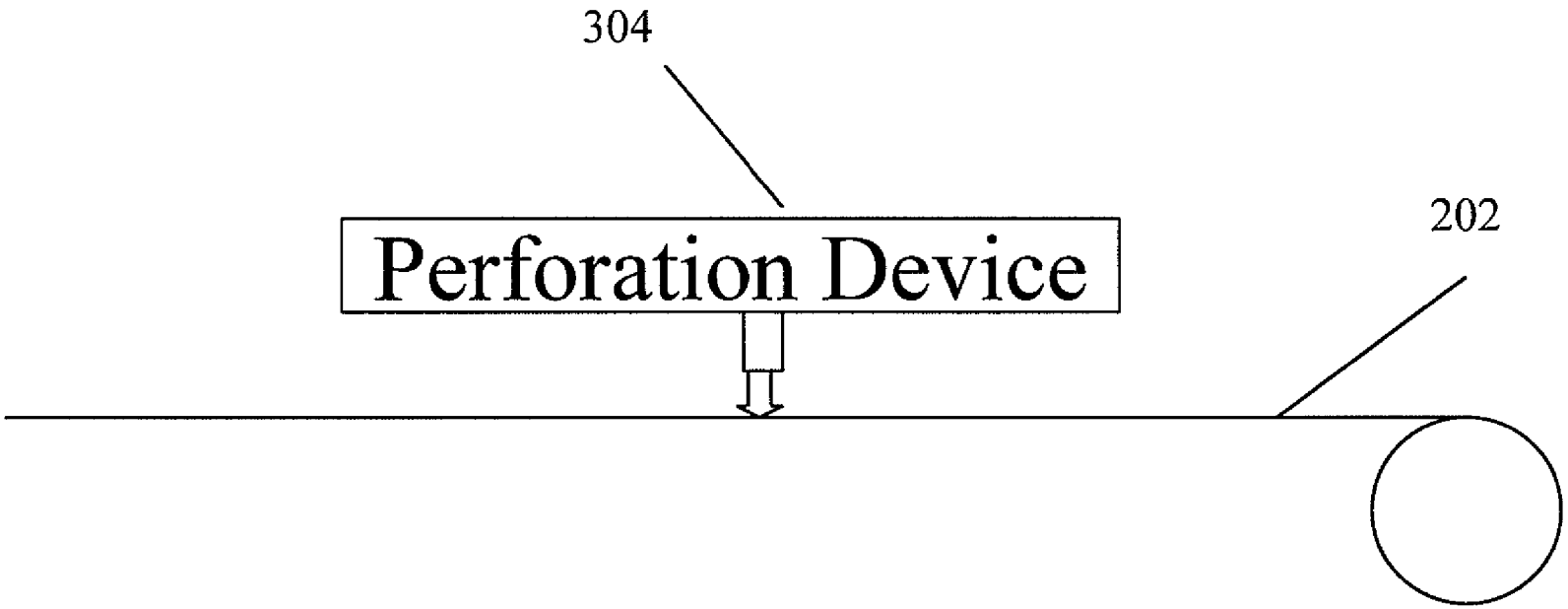
FIG. 3 is a side view of printed paper depicting the insertion of dimples through use of a perforation device.

FIG. 3 illustrates use of a perforation device 304, such as a comb perforator, guillotine perforator, harrow perforator, or rotary stamp perforator, to facilitate bending of the sheet 202 into an accordion fold structure. Perforation machines may be offered by vendors such as American Perforator Co. or Martin Yale, or may be custom-built. A scoring apparatus, as may be acquired from Office Zone or other providers, may also be used in addition to, or in lieu of, a perforation device.

Figure 4:
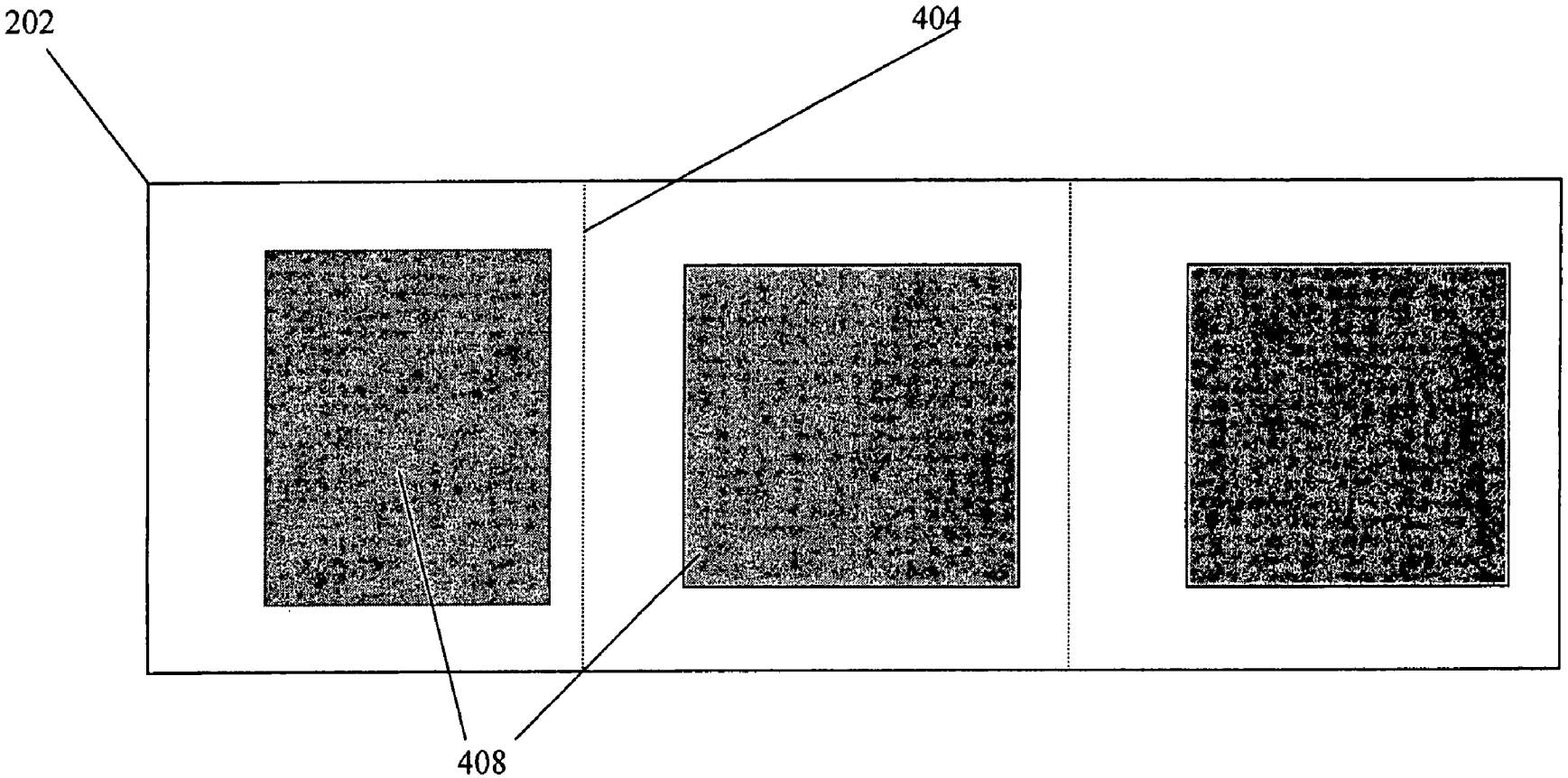
FIG. 4 is the resultant sheet of paper with perforations delineating pages, and images or text depicted on the pages.

Referring to FIG. 4, following application of the perforation device, as shown in FIG. 4, the sheet 202 contains perforations 404 at the juncture of the pages, between any preprinted images or text 408. The perforations 404 reduce the stiffness of the material that forms the sheet along a line that crosses the sheet in a direction perpendicular to the longitudinal axis of the sheet, so that when folded (as shown below), the sheet 202 tends to fold along the perforations 404. The perforations 404 define the edges of the pages of the book, so that when the sheet 202 is folded, it folds at the edges of each page, rather than in the middle of any page.

Figure 5:
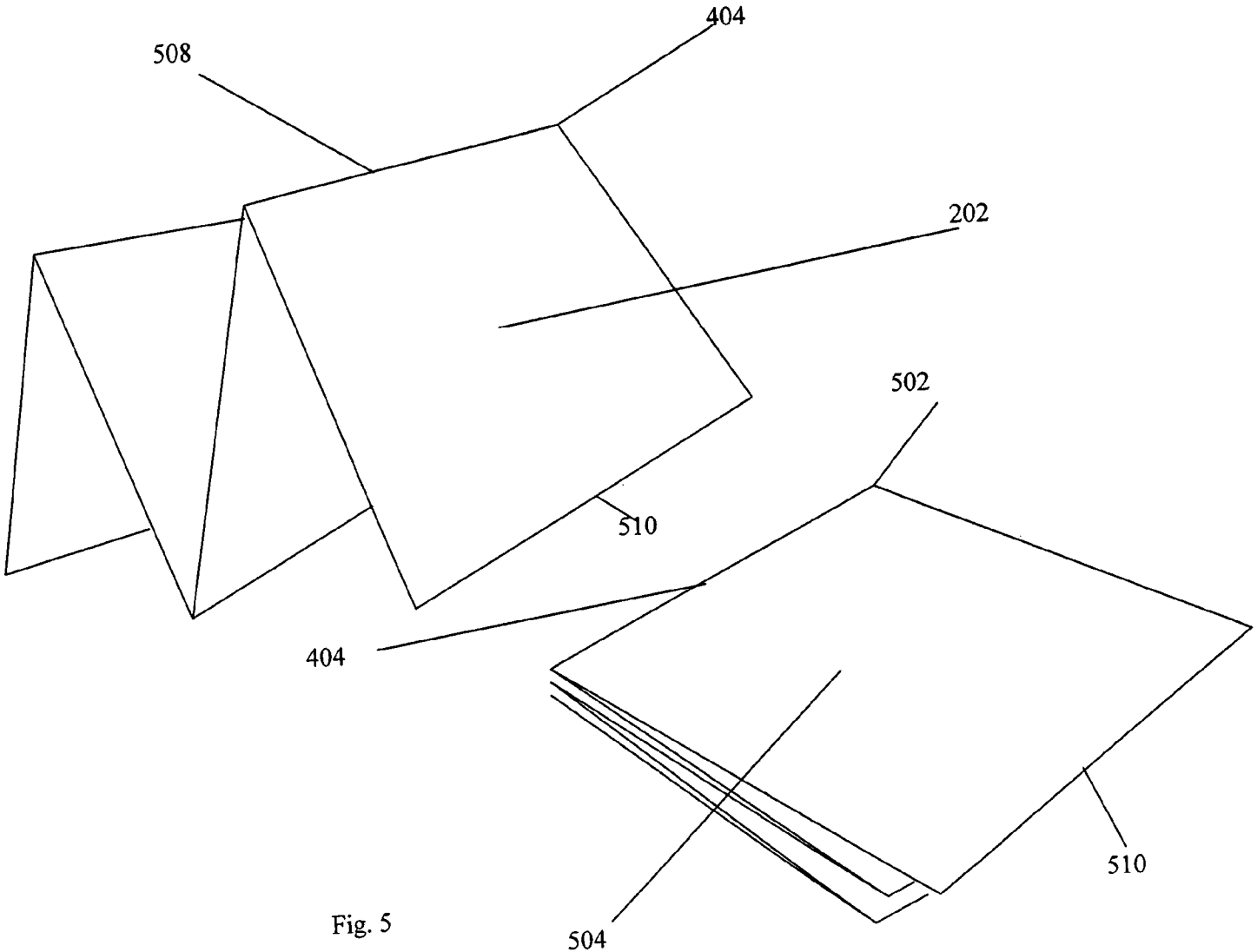
FIG. 5 sets forth two perspective views of the sheet after being bent in an accordion folded structure to create pages.

As illustrated in each perspective shown in FIG. 5, a bending facility or apparatus, which may include either a mechanical folding device or involve hand folding, may be used to bend the sheet 202 along the perforations 404, in an alternating forward and reverse direction along a longitudinal axis of the sheet, to yield an accordion fold structure with an terminal page at each end 504. The pages will be stacked so that there is a binding side 508 and a distal side 510. In a preferred embodiment, the folded pages will have dimensions of approximately five feet by seven feet, although various configurations are also suitable. For example, and without limitation, based on conventional paper roll formats, page lengths may be 30 inches, 36 inches, 42 inches, 60 inches, 72 inches, 96 inches, or 120 inches, and page heights may vary accordingly.

Figure 6:
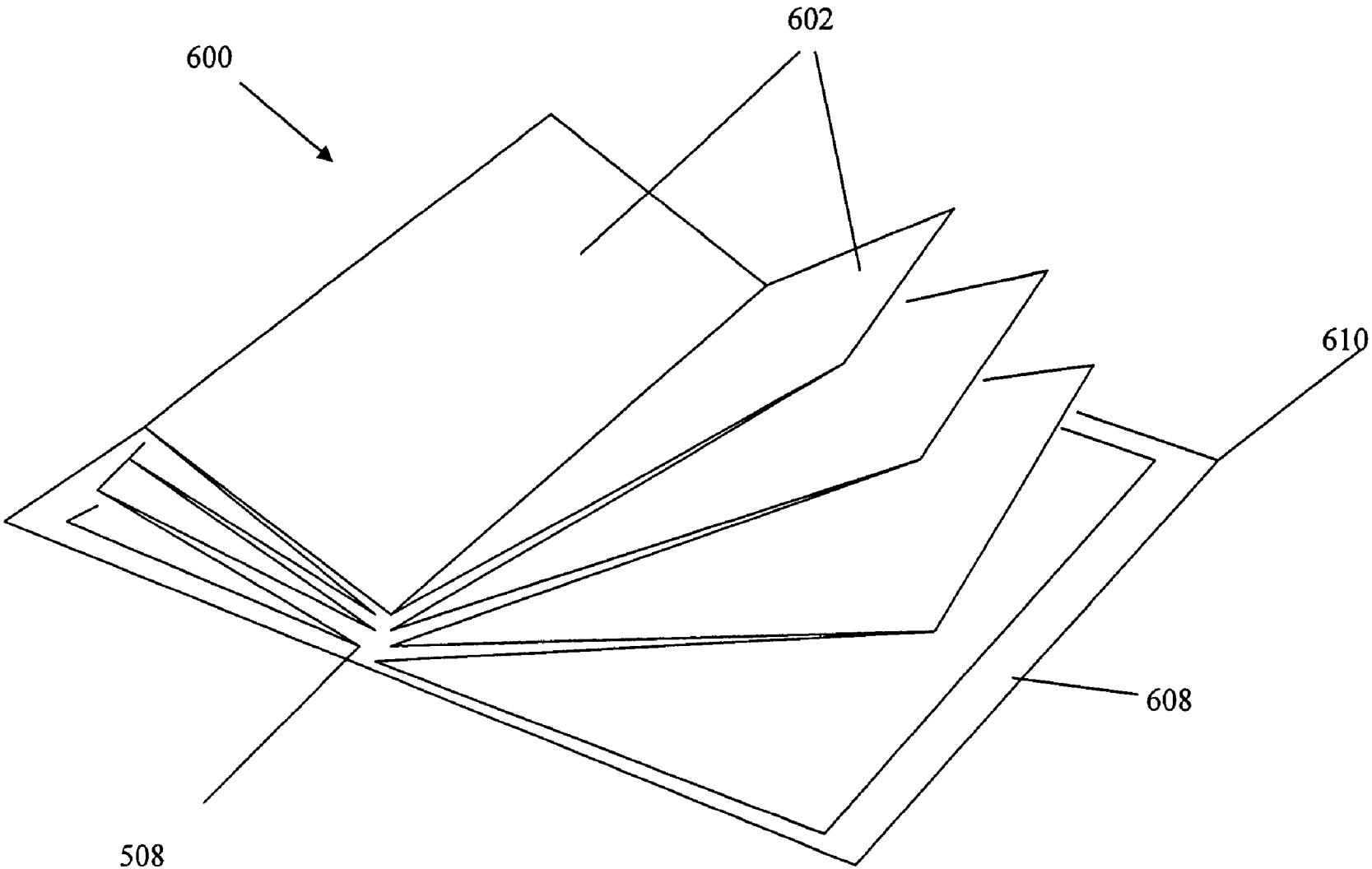
FIG. 6 is a side view of the book prior to binding.

Referring to FIG. 6, the folds described in connection with FIG. 5 result in a book 600, including pages 602. The pages 602 of the large-scale unbound book shown in FIG. 6 will be bound together along the binding edge 508 of the pages. In a preferred embodiment, the pages are affixed only at the binding edge 508 and left to slide freely at all other junctures so as to facilitate turning of the pages 602. A cover 608 may be associated with one or both ends of the book prior to binding. The cover 608 may be attached to one or both terminal pages of the book through use of an adhesive, such as tape or glue. Adhesives may generally include ethylene-vinyl acetate adhesives, nylon adhesives, seam tape adhesives, polyester adhesives, polyurethane adhesives, epoxy adhesives, silicone adhesives, and others as provided by 3M, Adhesive Films, and other providers. Adhesives may be activated through heat, electricity, microwaves, solvents, pressure, ultrasound, or other means known in the art. The cover may also be releasably fastened to one or both terminal pages of the book, through means known in the art. The cover 608 may be made of corrugated cardboard. A jacket cover may be fashioned for placement over one or both covers.

In FIG. 6, the corners 610 of the cover 608 may be reinforced to withstand forces. This may be accomplished by applying a warm or hot chemical or liquid adhesive, which is solid at ambient temperature, so that it penetrates the corners of corrugated cardboard reinforcements, and then causing or permitting the adhesive to dry and harden through elapse of time or use of an air-blower. Adhesive methods described in the immediately preceding paragraph may also be employed. Alternatively, corners of the cover may be plated with a rigid material, such as metal. The cover 608 may also include a pocket facility or slot for insertion of additional material, such as additional sheets or three-dimensional articles. It is also possible to add a front or rear cover, or both, following the binding steps described below.

Figure 7:
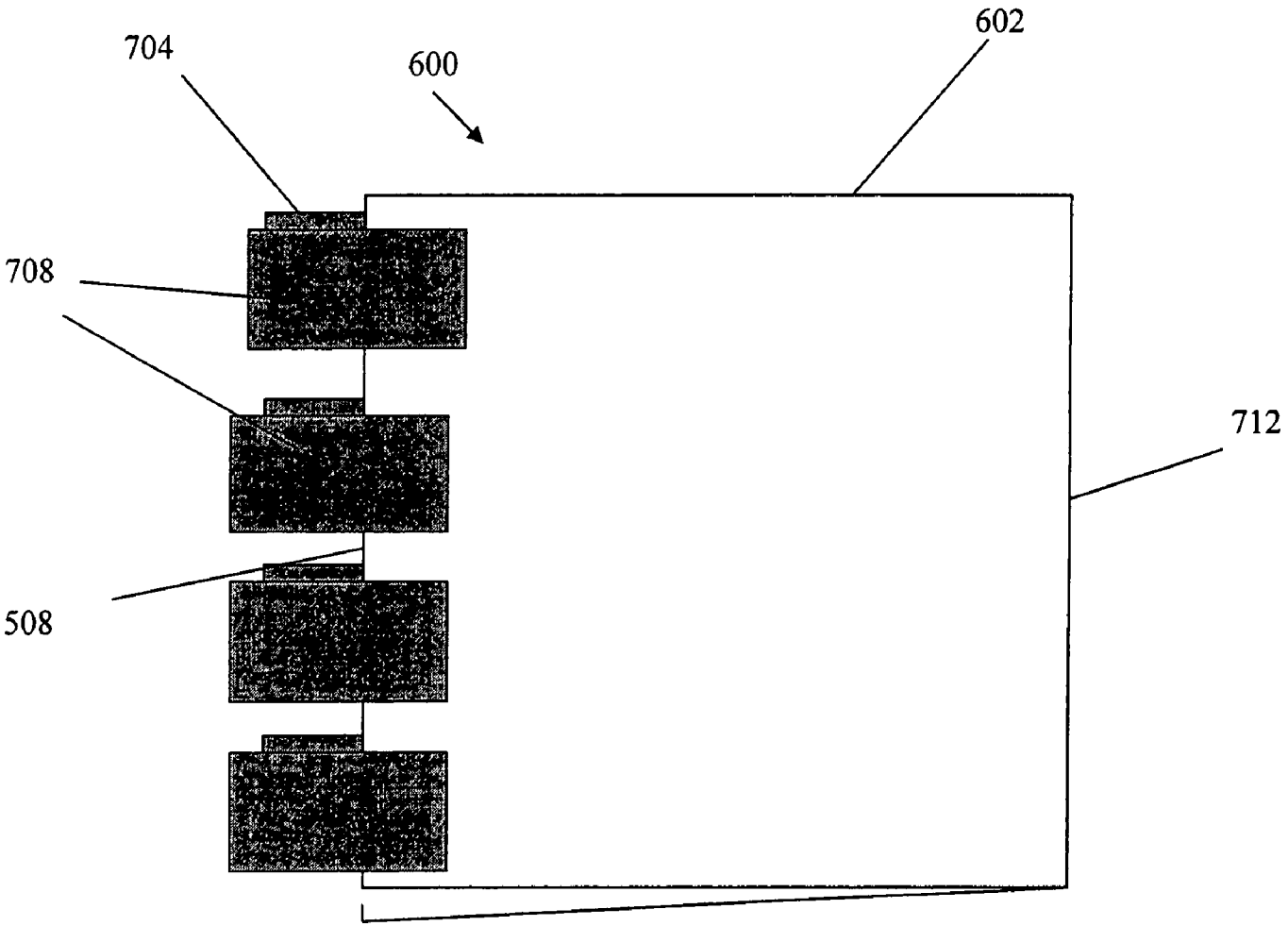
FIG. 7 depicts insertion of cloth tabs along the binding side of the book.

The book may be bound through tabbed binding means, stitched binding means, perfect-binding means, cloth binding means, tape-binding means, hinge-binding means, or any combination of the foregoing. FIG. 7 illustrates a preferred method of binding the pages to form a bound volume. A single elongated tab, or a multiplicity of tabs 708, which may be cloth, cardboard, plastic, or another durable material, may be appended to the binding edge 508 of the pages. Tabs 708 may be inserted around each individual fold or, alternatively, may be in interleaved among groups of folds. In a preferred embodiment, at least four sets of tabs 708 will be used, which such may advantageously be uniformly distributed long the length of the spine. Each tab 708 will be connected to each other tab 704 below it in the stack, to form a plurality of pages 602 of the book 600, each with a distal end 508.

Figure 8:
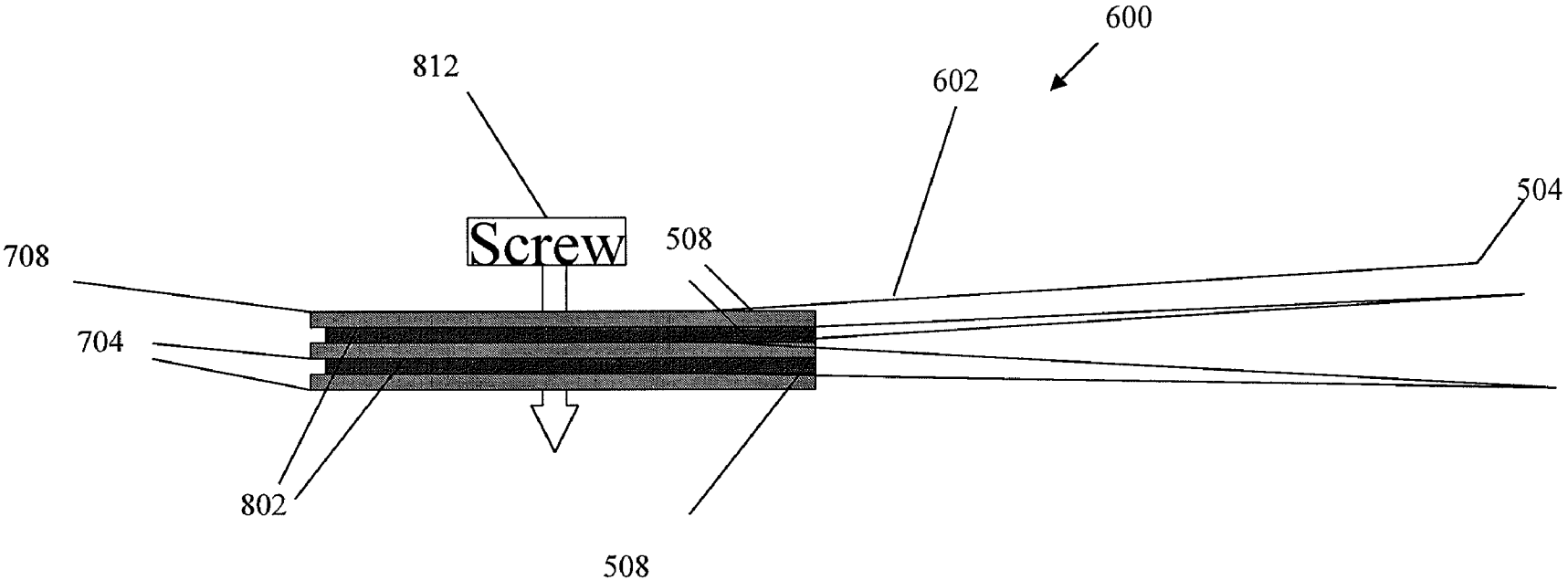
FIG. 8 shows insertion of screws to stitch the cloth tabs together and bind the book.

FIG. 8 depicts one method of stitching through the tabs to create a spine. In a preferred embodiment, the pages will be stitched together through use of a fastener facility, which may include screws 812, bolts, posts, strings, a combination thereof, or similar means known in the art. In the embodiment described by FIG. 8, cloth tabs 708, 704 are attached to the binding edge 508 at each fold of the book. A screw 812 may be inserted vertically through the cloth tabs to secure a binding. Each end page 504 of the book 600 may be outfitted with a cover either prior to binding or after binding. Pages 602 of the book may be freely turned. It may be advisable to include a reinforcement facility to more firmly and permanently secure the binding of the book. One method of reinforcement includes insertion of a cardboard binding element 802. This may be either a strip of cardboard inserted along the vertical axis of the binding side of the book, or individual strips of cardboard associated with each set of binding tabs 704, 708. In addition to stitching, other bindery operations may be used, such as stapling, clipping, comb binding, tape binding, clamping, perfect-binding, pasting, cloth-binding, spiral binding, tape-binding, hinge-binding, post-binding or wire-o binding.

Figure 9:
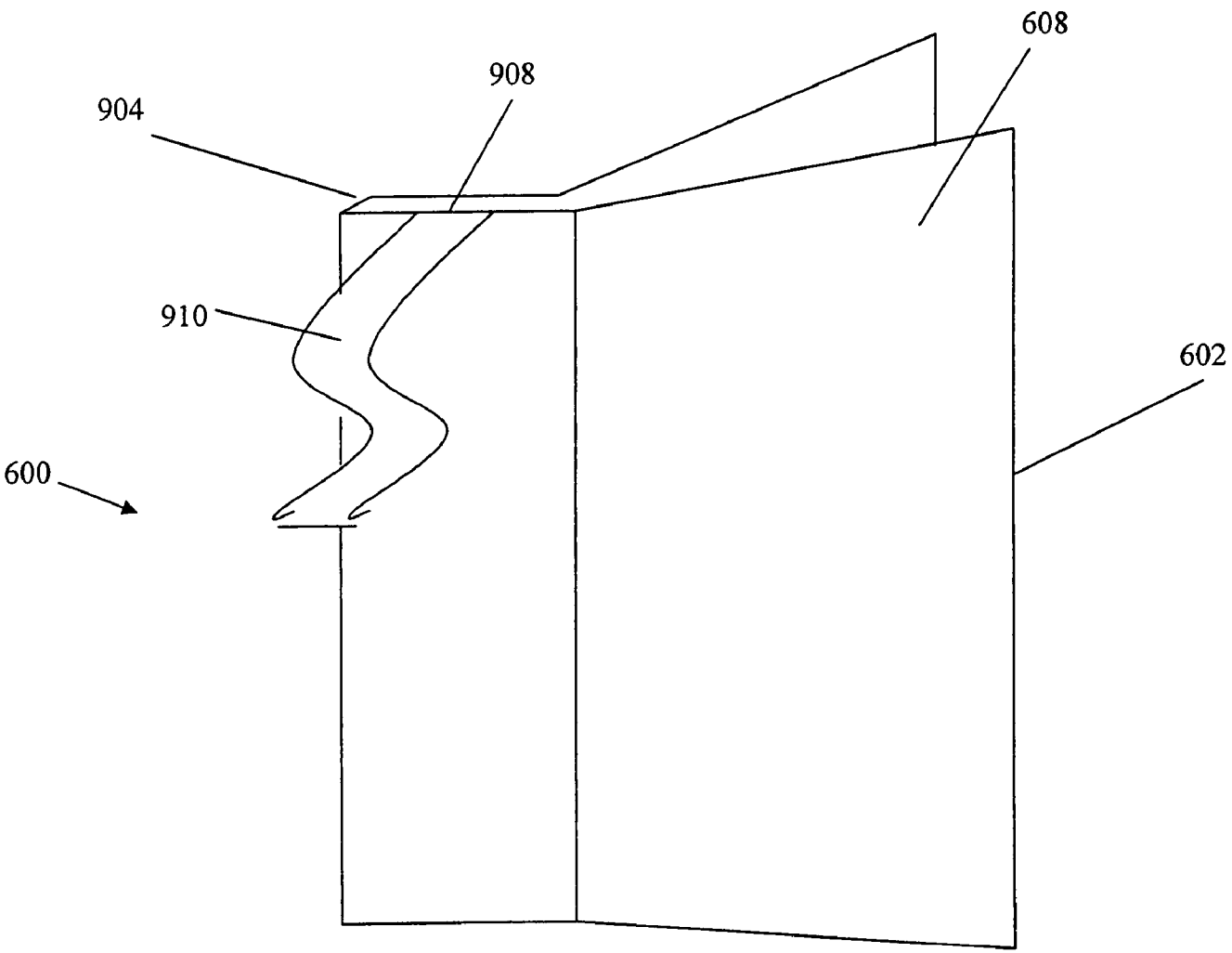
FIG. 9 shows a side view of the resultant bound book.

When stitched with tabs 704, 708 and provided with a cover 608, a book 600 results, as shown in FIG. 9. The resultant large-scale book includes a binding 904, a plurality of pages 602, and a nose 908 that holds the binding 904 in cases of certain preferred binding processes.

In embodiments, a ribbon 910 may be affixed to either a cover 608 of the book or to the binding 904 of the book, to serve as a placeholder or as a decorative element. In addition, a releasable latch may be affixed to the covers or terminal pages of the book in order to fasten the book and retain it in a closed position. This may serve to protect the book's contents, or facilitate transport of the book. The releasable latch may include a locking mechanism, such as a key facility or combination lock facility.

Figure 10:
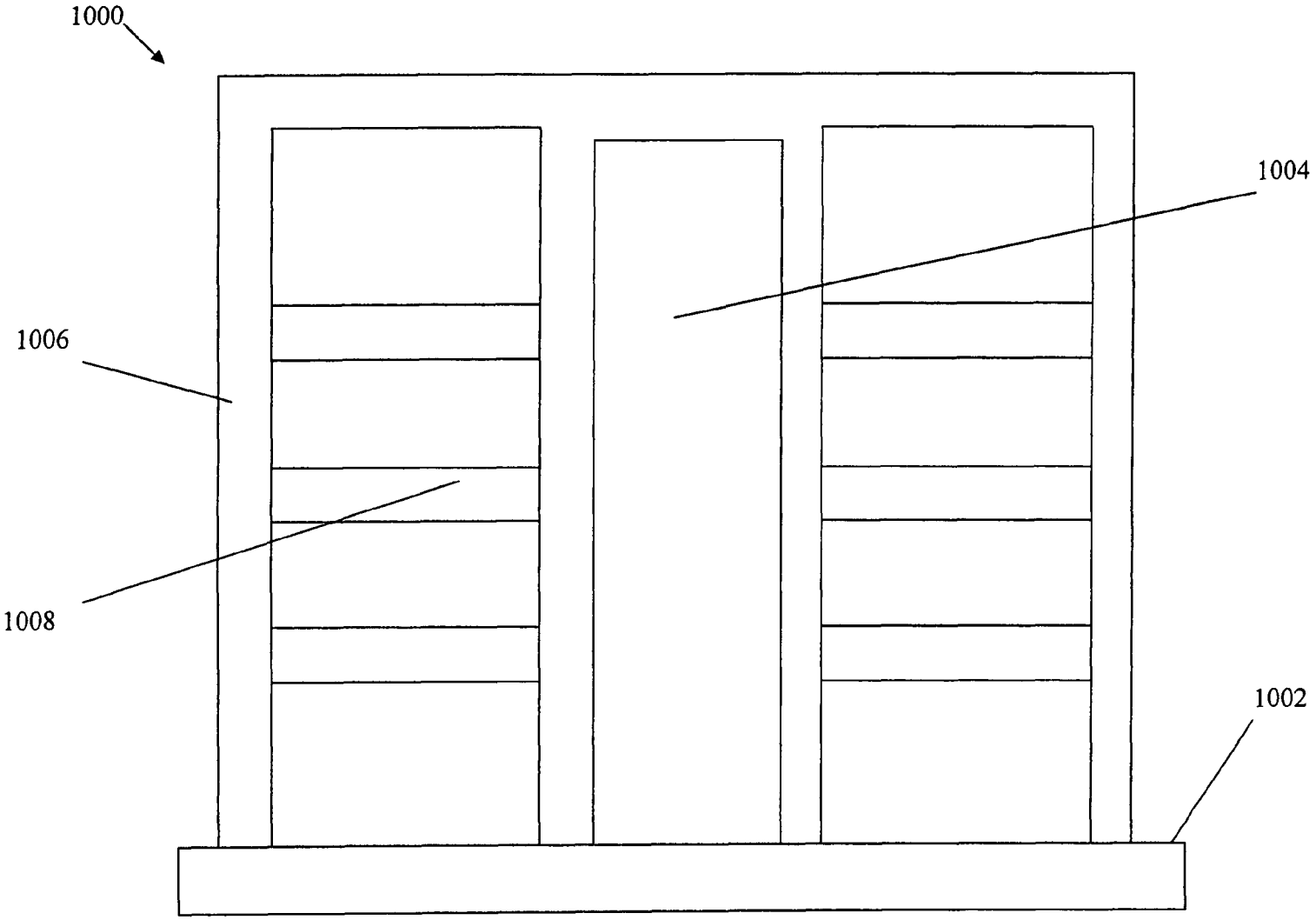
FIG. 10 depicts an example of a stand configuration for the book.

In embodiments, the book 600 may be situated on a stand 1000, such as that shown in FIG. 10. As depicted, the nose of the book would be positioned through a gap or recess 1004, and various structural elements 1006, 1008 would supply a means to support the book 600. The stand 1000 may have a platform 1002 to interface with the floor and to hold the bottom of a book. In embodiments the platform 1002 may resemble the bottom of a music stand, jutting out from the bottom of the platform 1000 substantially perpendicularly from the back of the stand 1000. In embodiments, the stand 1000 may be made of wood, metal, aluminum, steel, composite, plywood or any other substantially rigid substance.

Figure 11:
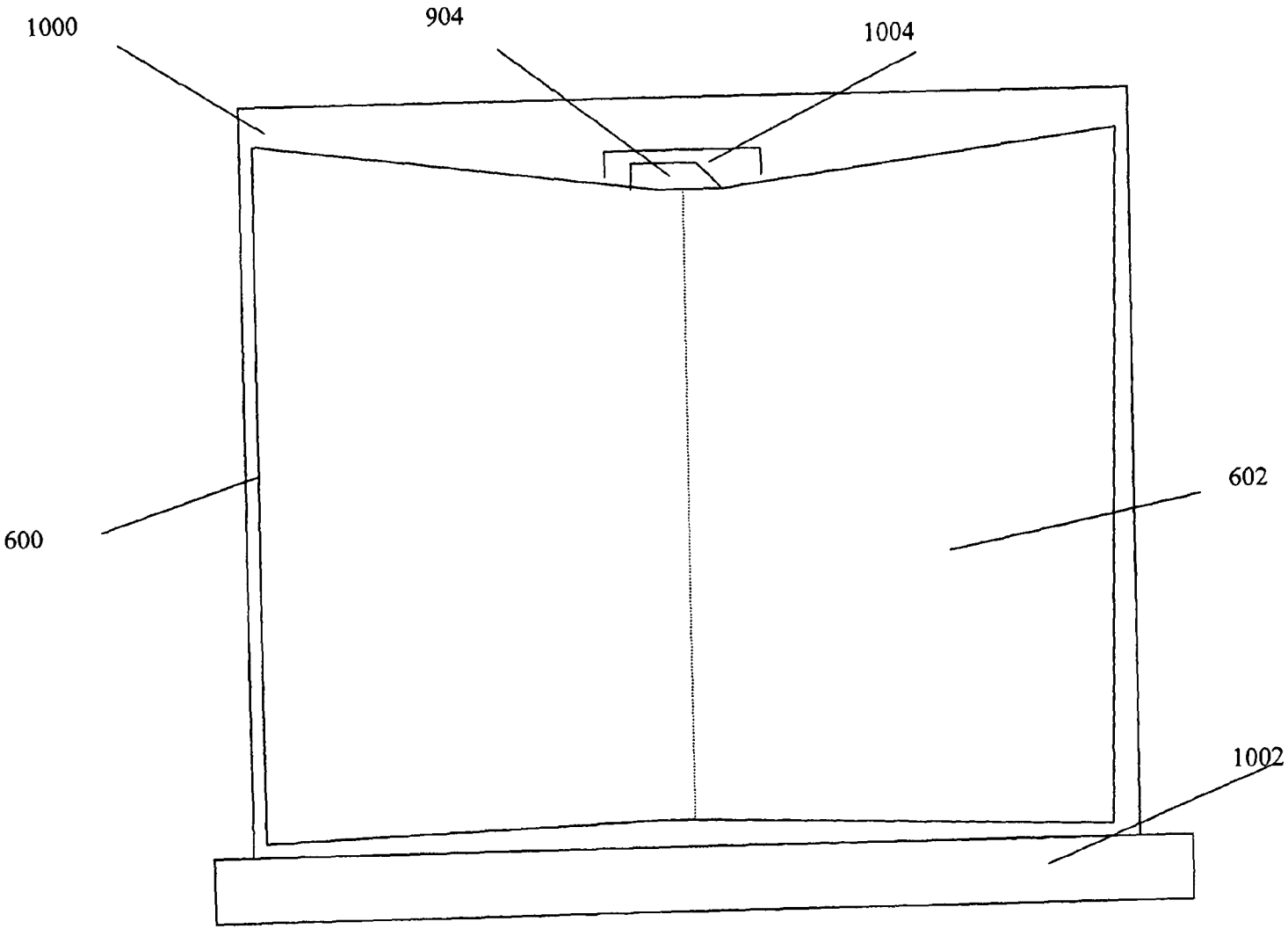
FIG. 11 is a view of the book disposed on a stand.

Positioned in the stand 1000, the book 600 may be observed as shown in FIG. 11. As illustrated, the nose 904 holds the binding of the book 600 and projects through the gap 1004, facilitating holding the book 600 on the stand 1000. The stand may include a stable floor element 1002.

Figure 12:
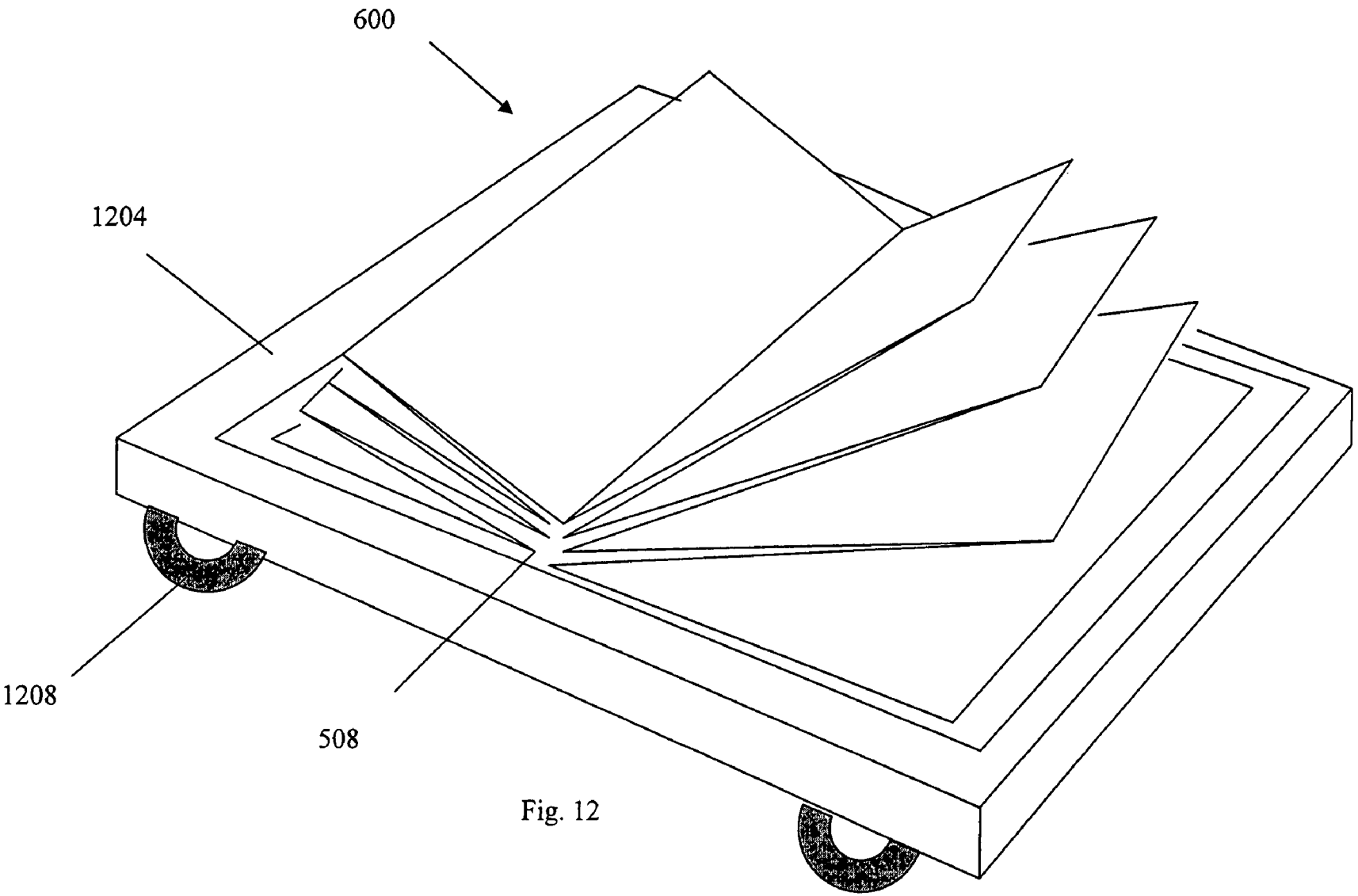
FIG. 12 is a view of the book situated on a transportation facility.

Referring to FIG. 12, a transportation facility 1202 may be provided with the book 600. As shown in FIG. 12, the book 600 may be situated on a supporting platform 1202 with wheels 1204. In embodiments, the stand 1000 itself may also serve as a transportation facility, if it is outfitted with wheels or another means of locomotion. Alternatively, the stand 1000 may be transportable through use of the same transportation facility used to move the book. For example, the spine of the book, cover of the book, or jacket cover of the book may be fitted with wheels or non-slip surfaces to facilitate conveyance. Wheels may also be releasably secured to a specified location on the exterior surface of the book. Wheels could be affixed to multiple edges of the book to permit the book 600 to be moved along various axes. A belt assembly (either affixed or removable) with wheels, which would slip around the perimeter of the book 600 when the book 600 is to be transported, may be fashioned for the book 600. In embodiments, the book 600 may be provided in a kit together with a customized transportation facility 1202 suitable the particular book 600.

The large-scale book 600 may be used to commemorate an event, such as a wedding, holiday, anniversary, birth, graduation, vacation, historical event, or other significant affair. The book could also be dedicated to a geographic region of the world, such as a country and its culture, or it could relate to a demographic or social group, such as the people of a given region of the world, or a student population.

In embodiments, the book could greet patrons at a restaurant with a menu of available items to order, or it could entice store customers with large, perhaps full-sized, vibrant pictures of available items, which may include furniture of actual dimension. The book could be used to showcase wallpaper, paint, window designs, doors, or murals in a format approximating a wall. The book could be displayed within a museum, or as a means to remotely exhibit museum articles, by making available to the public scaled or actual sized images of rare or precious artifacts, gemstones, artwork, or archeological discoveries. The book could be placed decorously at a national or local cemetery to commemorate fallen brethren, or implemented as a war memorial. The book may also serve to showcase artwork in vivid detail, including a portfolio of designs generated by a commercial graphic arts studio. Large-scale booth exhibits produced for a conference may be memorialized in book format, or a large-scale book may entice patrons to a booth at an exhibition hall. Full-sized faces, or life-sized full-bodied portraits, may be preserved in book format for perpetuity.

In embodiments, medical procedures could be graphically depicted at actual, or even enlarged, dimension without the disorientation of frequent page-breaks. Astronomical formations could be depicted in large-format swaths of the sky. Within a public forum, a large book may provide a means for creative public input or accommodate expressive graffiti or words of public protest. Within an international conference center, each page could include a full-sized flag or emblem of participating nations. Holy or religious texts, such as a bible, torah or Koran may be reproduced in grand fashion to be shared by a religious congregation. A high school or university yearbook may include life-sized photographs of school events. Sporting events may be captured in explicit detail for collectors, museums, or galleries. A crossword puzzle book of record proportion can be constructed. Concert tours can be memorialized in striking detail and vivid color. An entire newspaper can be laid out on a single page or adjacent open pages of a book. A large book could serve as a megalithic coloring book or paint-by-number for a group of children.

Figure 13:
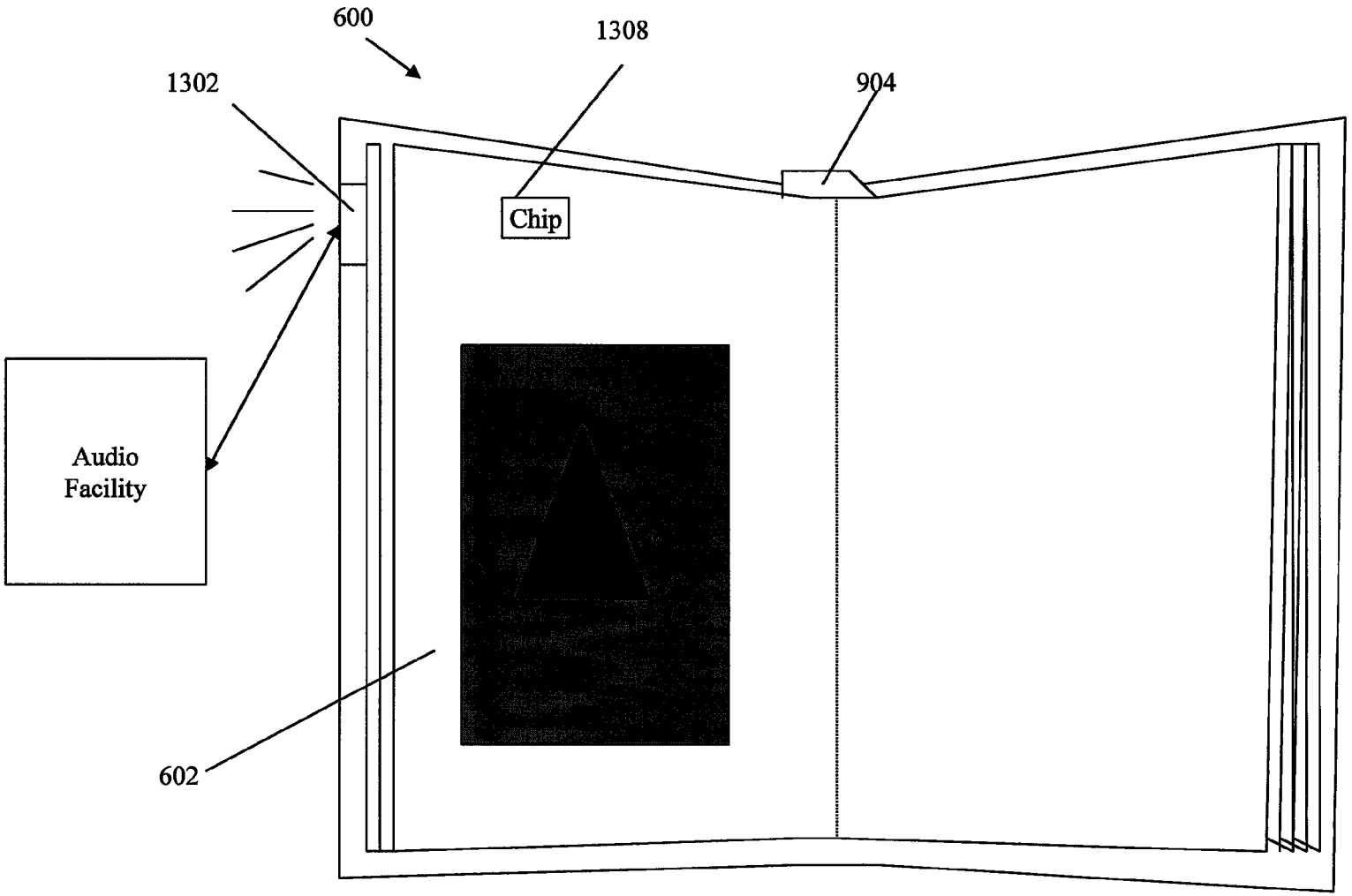
FIG. 13 shows an embodiment of a book associated with an audio facility.

Referring to FIG. 13, in embodiments, a large book may be combined with an audio facility 1302, such as a tape player, CD player, DVD player, MP3 player, speaker 1304, or other facility, that is intended to be heard while the book is viewed. For example, an audio tour may be provided through the pages of the book, with speech, music, sound effects, or other audio accompaniment that is associated with the content of the book. For example, a recording of a nature environment could be played when a page is opened to a nature scene. An audio track could be provided to guide a user page-by-page through photographs, so that the book provides an immersive experience, both as to visual and auditory content. In embodiments the audio facility may be sold or otherwise provided with the book, such as in a kit.

In embodiments, the audio facility can be associated physically with the book, such as by including a speaker 1304 attached to the cover with a triggering facility 1308, such as a microchip embedded in one or more pages of the book. For example, turning a page, touching a page, or taking a similar action may trigger the audio facility, such as triggering the playing of an audio file when a page is turned. In embodiments the audio facility may be made part of an interactive facility, so that touching the book in a particular location or using an actuator, such as a pen, mouse, pointer or other device having a sensor/signal facility, triggers particular interactions when the triggering facility is placed in a particular location. Thus, by touching a particular page or portion of a page, a user may initiate content associated with touching the page. For example, a user might touch a person and hear an audio file of the person's voice. A user might point to a musical score and hear music for the score. A user might point to a dialog box, such as in a comic strip, and the user might hear the dialog.

Other embodiments of interactive books are known to those of skill in the art and are encompassed herein. Combined with the scale of the giant books disclosed herein, such interactive facilities offer an immersive experience different from any conventionally sized book.

Figure 14:
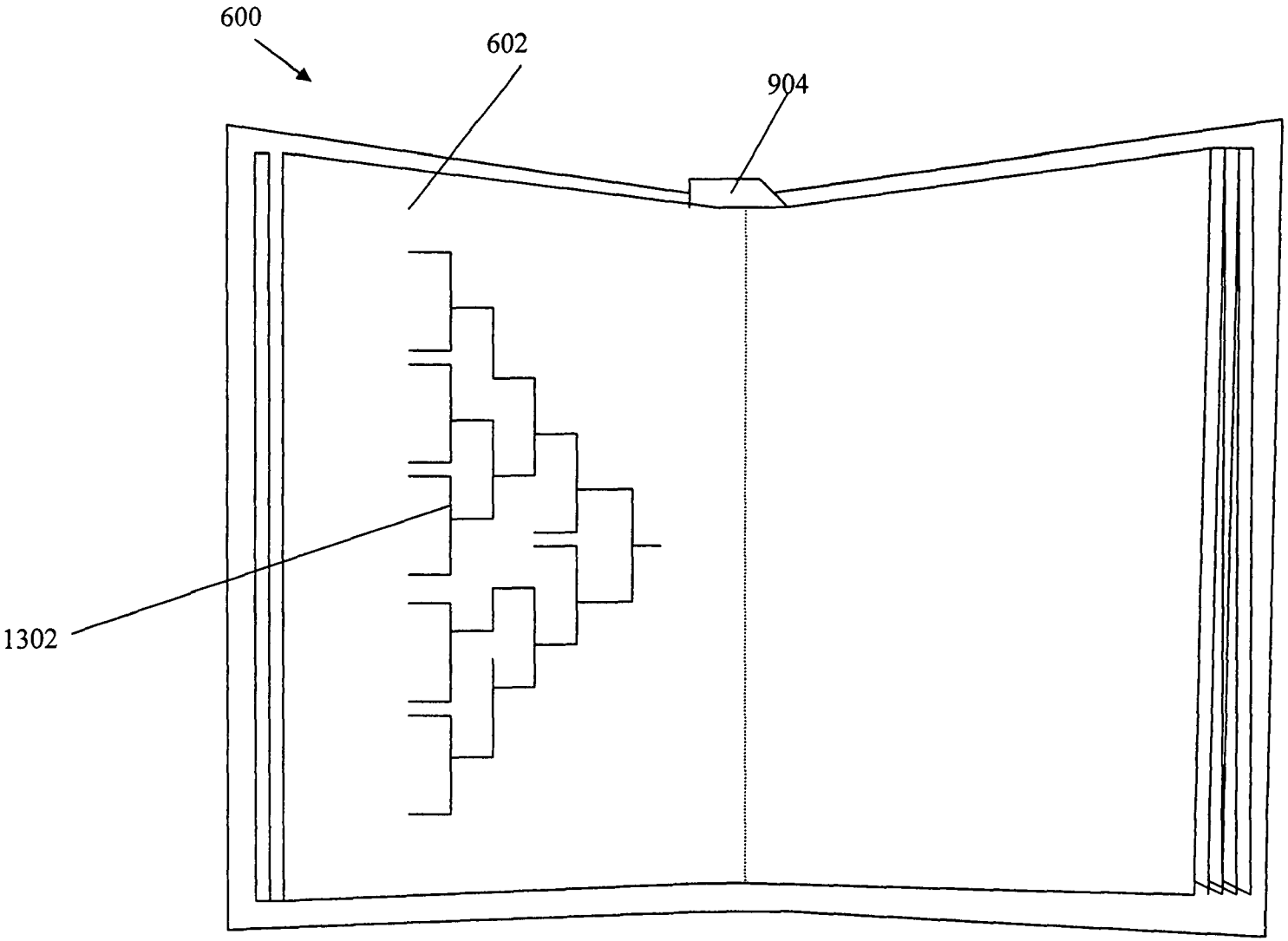
FIG. 14 shows an embodiment of a book for displaying genealogical information or similarly complex graphical information.

Referring to FIG. 14, one embodiment of a giant book is to represent genealogical information 1404. Genealogical information is often provided in trees, graphs, or similar structures, where the size of a conventional severely limits the number of generations that can be presented on one page, resulting in complicated cross-referencing schemes. A giant book can accommodate many generations of genealogical information on a single page, and with multiple pages a giant book can represent various branches of an individual's family tree, as well as photographs, text, and other information representing events or characteristics of an individual's life. Thus, by allowing presentation of more data in a single page, a large format book allows a uniquely powerful representation of an individual's life, such as for biographical or autobiographical purposes.

In the embodiment of FIG. 14, the book may provide genealogical information for a family of individuals. As shown in FIG. 14, a book 600 contains large pages that readily accommodate a vast amount of graphically-displayed family tree relationships 1402. The format may also be applicable to mapping evolutionary information of various species of life. In general, the large format of the book's pages is suitable for graphically demonstrating any complex interrelationship of elements or members of a group. The format may also be applicable for depicting directed graphs used in developing software code, such as to depict code with a large number of elements. The format may be applicable for depicting complex processes or flow diagrams, such as for manufacturing or logistics applications.

Figure 15:
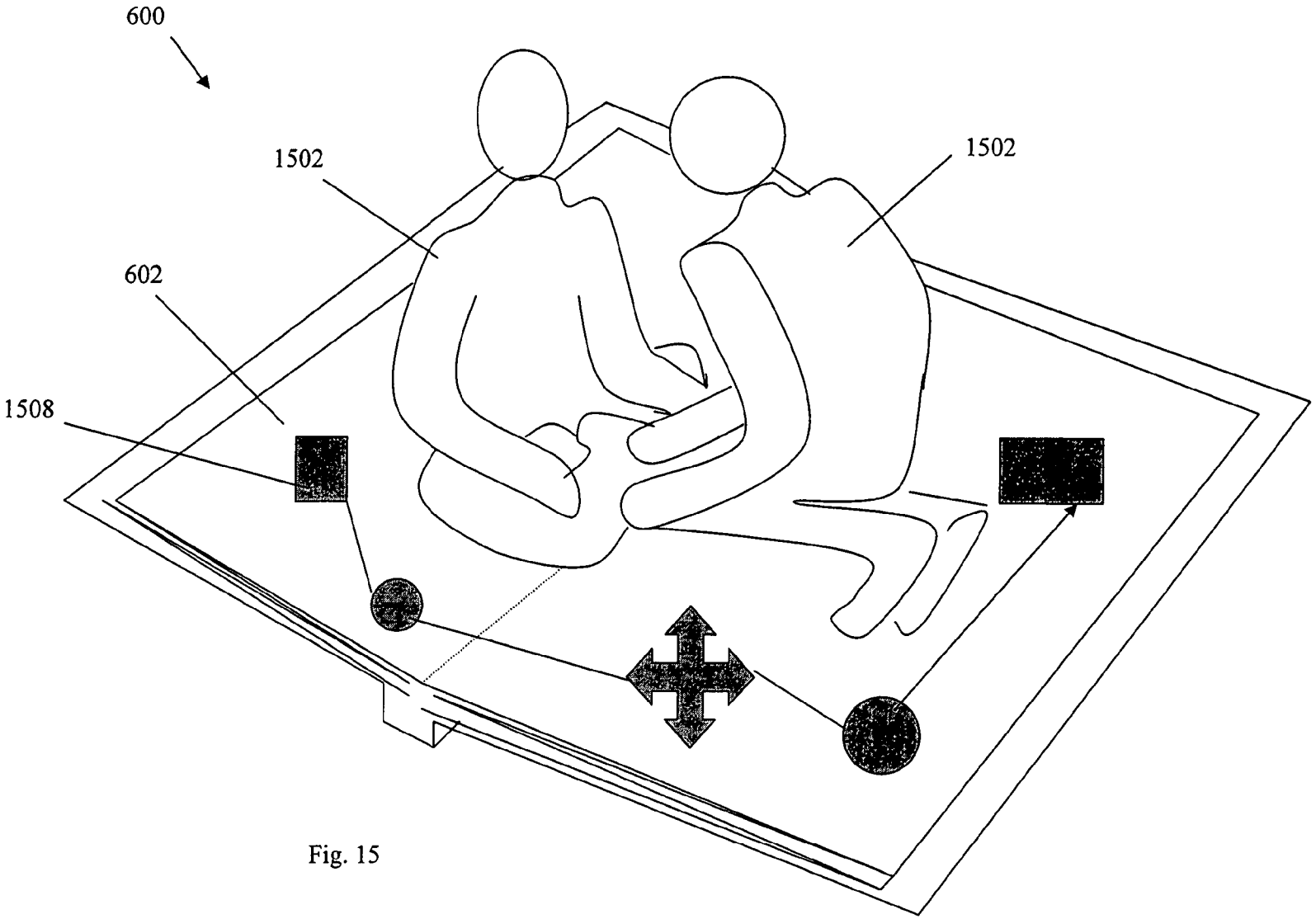
FIG. 15 shows an embodiment of a book for facilitating game playing.

Referring to FIG. 15, in an embodiment, the book 600 may include tactile, audio, graphical, electronic, or multimedia components. For example, the book may reside on a floor and may allow a child to sit directly on the book 600 to access educational, game or entertainment components dispersed throughout various pages. These components may accompany text, or may be provided in lieu of text, and may, for example, allow a child to immerse himself in various activities throughout the book's pages. As depicted in FIG. 15, an individual 1502 is shown interacting with the book 600 with access to game features 1508 that respond to such individual's input. The pages may also be imprinted with text or images in three-dimensional fashion, such as brail text, or graphical images forming a hopscotch game. A chip or similar facility can allow the user to interact as with an electronic game. The game 1508 depicted on the page 602 might be a traditional board-type game, such as Risk, Scrabble, Trivial Pursuit, a fantasy role-playing game, Dungeons and Dragons, a strategic game, chess, checkers, backgammon, poker, or any other known game.

Figure 16:
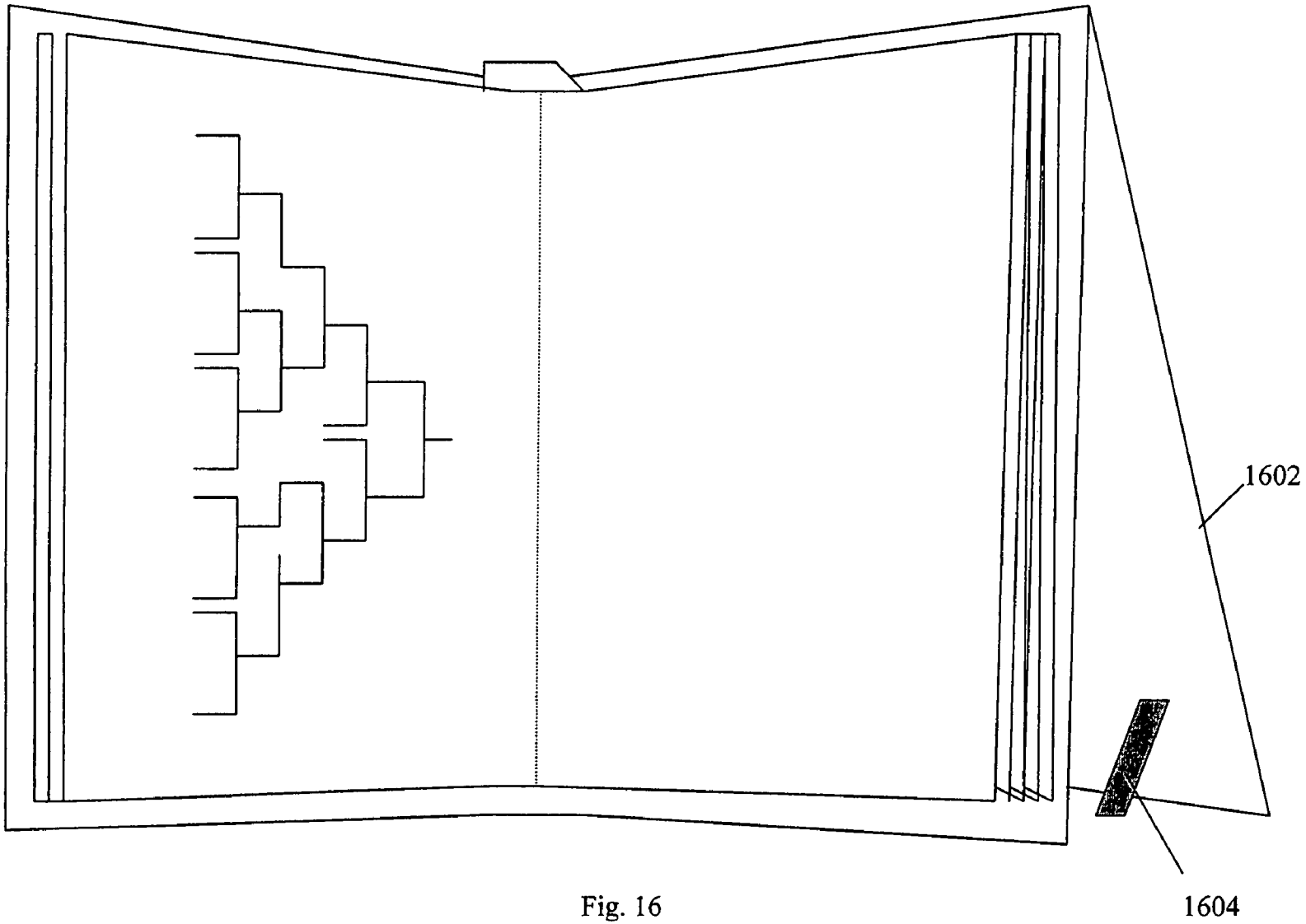
FIG. 16 shows an embodiment of a book with an integrated stand.

Referring to FIG. 16, in another embodiment, a rear cover 1602, or second rear cover, may be mounted to the top portion of the book 600 so that, upon outward rotation, it functions as a supporting element for the book. Articulated structural members 1604 may support the rear cover 1602 stand or alternatively append to the spine or cover of the book to support and position the book in an upright or leaning position.

Figure 17:
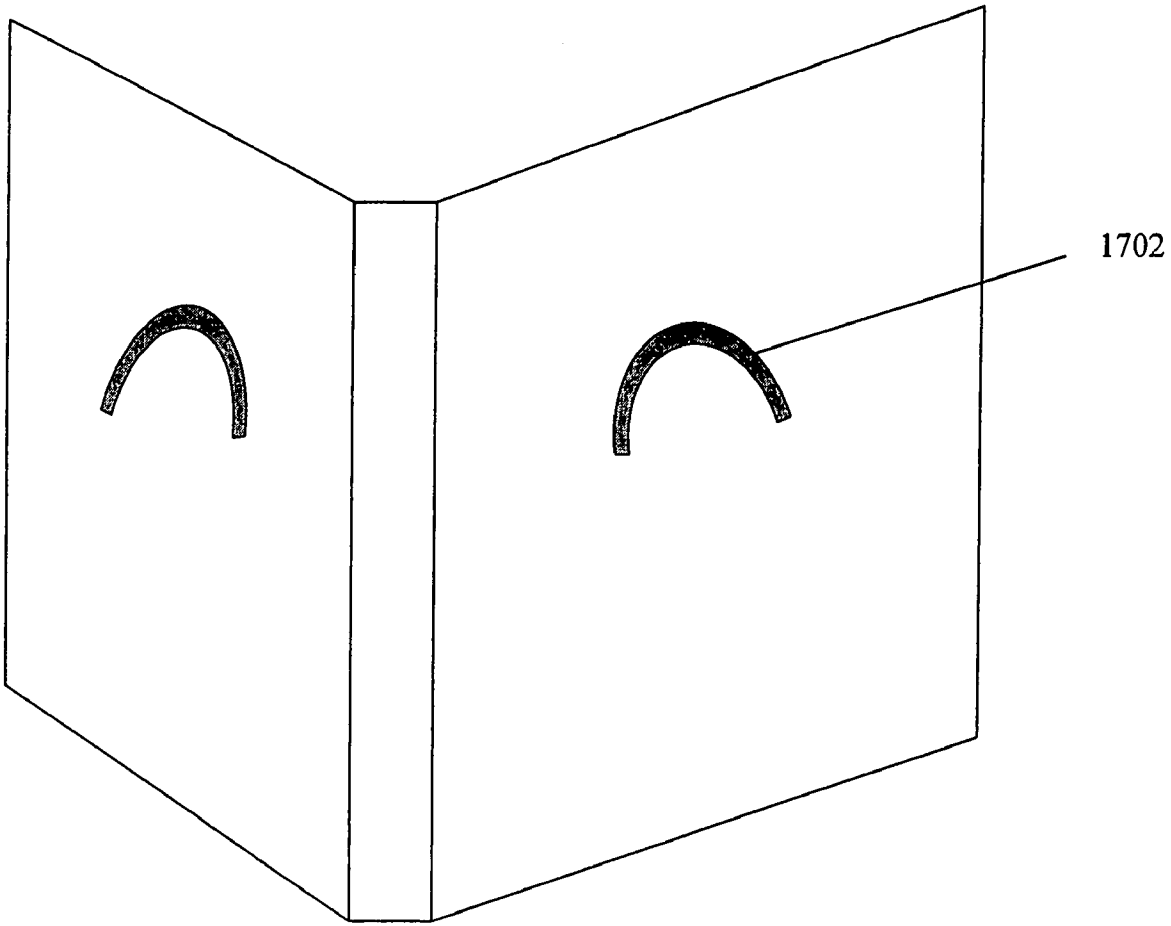
FIG. 17 shows an embodiment of a book with a facility for attaching the book to a wall.

Referring to FIG. 17, the book 600 may also include a fastening means on its rear cover or its spine to allow the book to be maintained in an upright position. For example, a latch assembly 1702 may be included to facilitate wall-mounting.

Figure 18:
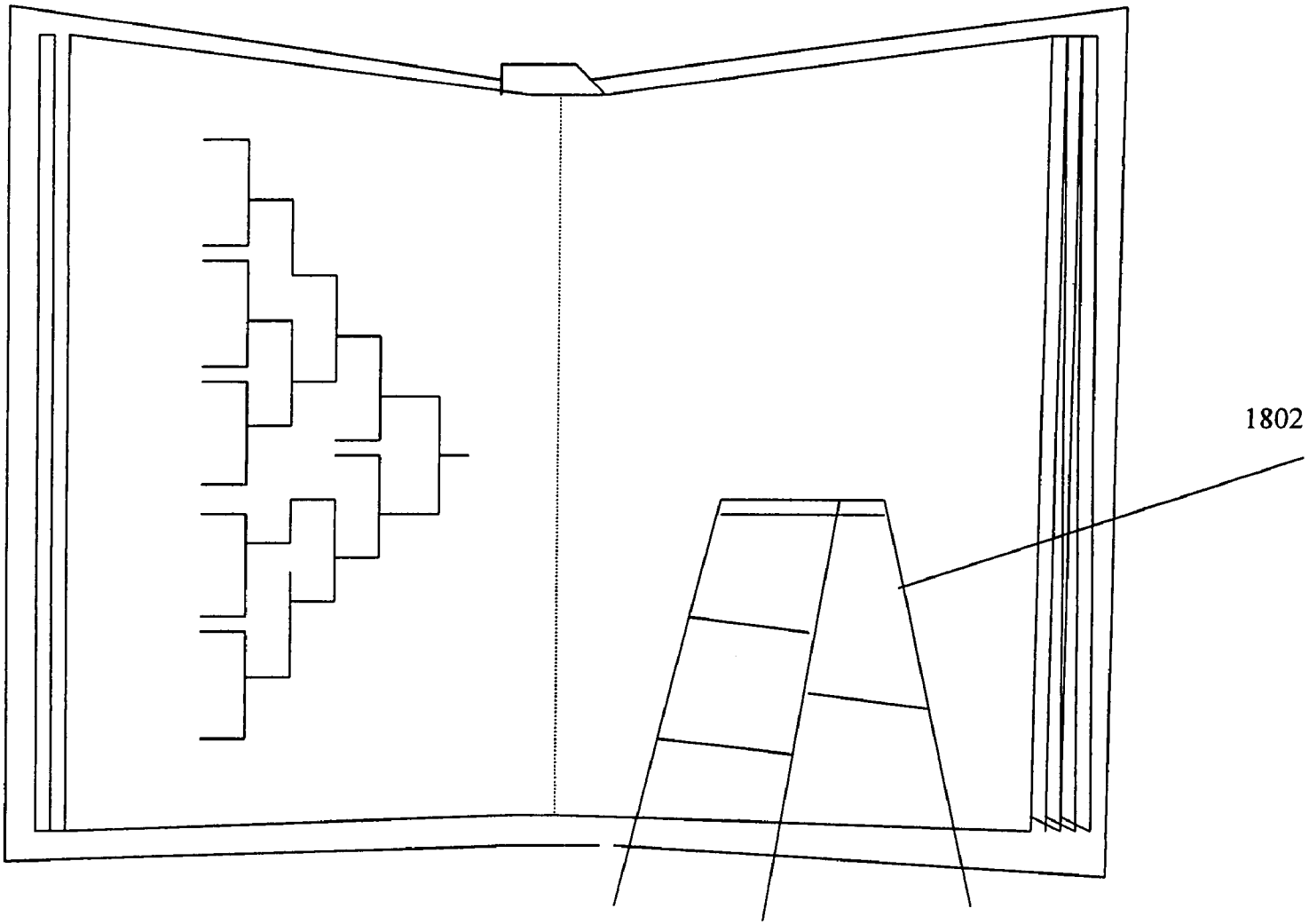
FIG. 18 shows an embodiment of a book with an associated ladder.

Referring to FIG. 18, a large book accompanied by a ladder 1802 or other structure accommodating safe climbing to various regions of the book can serve to generate interest in reading amongst children.

Figure 19:
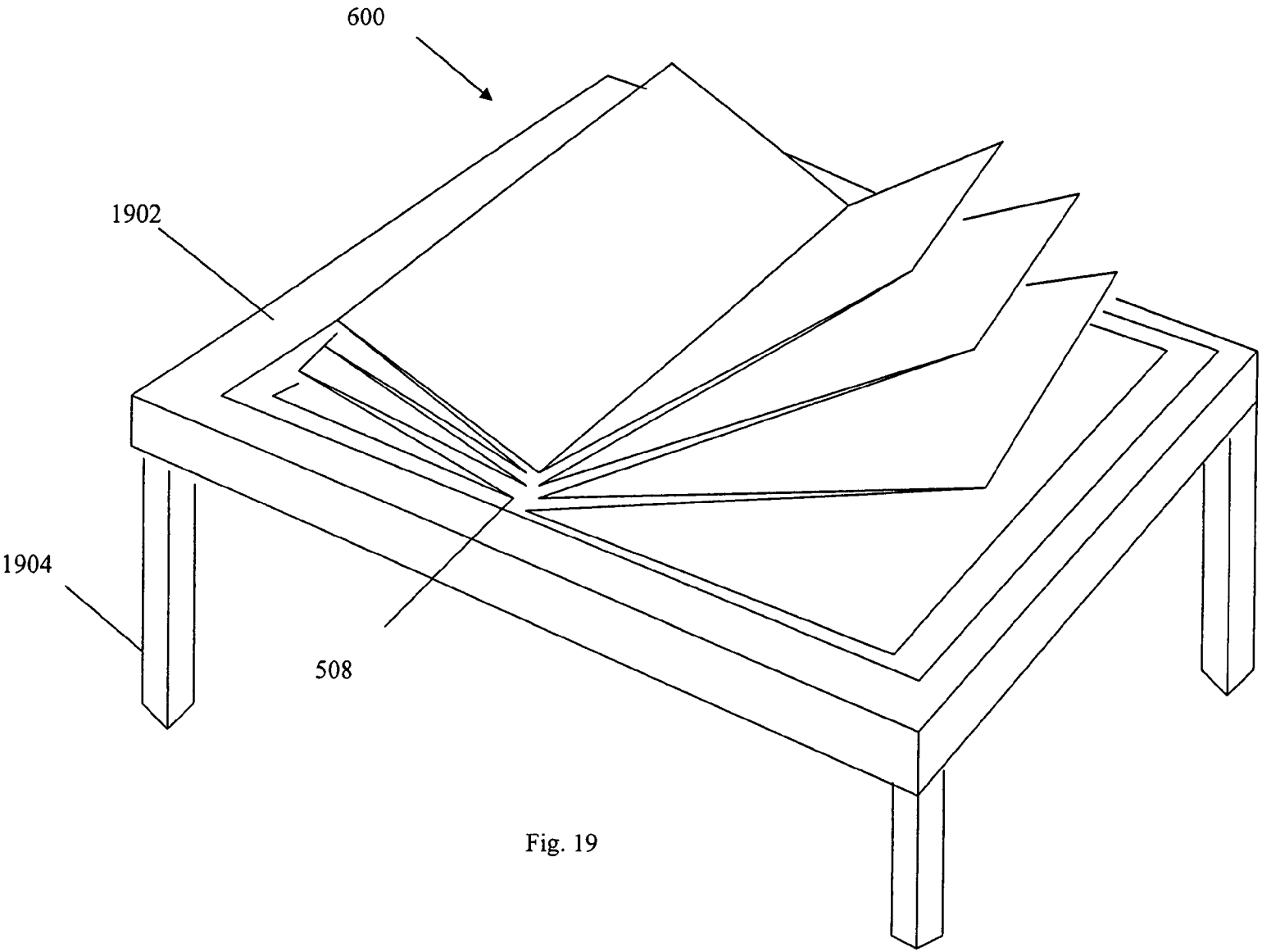
FIG. 19 shows an embodiment of a book integrated with an item of furniture.

The large-scale book may also serve as a three-dimensional wall decoration, or as a functional piece of furniture. For example; referring to FIG. 19, by integrating the book 600 with a platform 1902 and legs 1904, the book 600 may function simultaneously as a "coffee-table" book and coffee table.

Having thus described several illustrative embodiments, it is to be appreciated that various alterations, modifications, and improvements will readily occur to those skilled in the art. Such alterations, modifications, and improvements are intended to be part of this disclosure, and are intended to be within the spirit and scope of this disclosure. While some examples presented herein involve specific combinations of functions or structural elements, it should be understood that those functions and elements may be combined in other ways according to the present invention to accomplish the same or different objectives. In particular, acts, elements, and features discussed in connection with one embodiment are not intended to be excluded from similar or other roles in other embodiments. Accordingly, the foregoing description and attached drawings are by way of example only, and are not intended to be limiting.

The invention claimed is:

1. A method for producing a large-scale book, the method comprising:

a. folding a sheet of pliable material in an alternating forward and reverse direction along a longitudinal axis of the sheet to create a plurality of folded pages;

b. positioning the folded pages into a stack, the stack having a binding side and a distal side;

c. for each of at least two pages, placing at least one tab on the binding side of each page; and d. binding the folded pages to form a book, wherein binding the folded pages comprises: fastening, with a non-removable fastening mechanism, at least a subset of the tabs directly to each other.

2. The method of claim 1 further comprising providing a stand configured to display the large-scale book, and displaying the large-scale book on the stand.

3. The method of claim 1, wherein the stand is a movable platform.

4. The method of claim 1, wherein the fastening is accomplished using at least one of a screw, a bolt, a post, a string, an adhesive and a tape.

5. A method for producing a large-scale book, the method comprising:

a. folding a sheet of pliable material in an alternating forward and reverse direction along a longitudinal axis of the sheet to create a plurality of folded pages;

b. positioning the folded pages into a stack, the stack having a binding side and a distal side;

c. for each of at least two pages, placing at least one tab on the binding side of each page; and d. binding the folded pages to form a book, wherein binding the folded pages comprises: attaching the folded pages at the tabs, with a non- removable fastening mechanism, wherein at least two tabs are directly attached to each other.

6. The method of claim 5, where attaching the folded pages is accomplished using at least one of a screw, a bolt, a post, a string, an adhesive and a tape.

* * * * *